United States Patent [19]

Mizuguchi et al.

[11] 4,141,785

[45] Feb. 27, 1979

[54] PROCESS FOR RECOVERY OF CHEMICALS FROM PULPING WASTE LIQUOR

[75] Inventors: Saburo Mizuguchi; Isao Nomura, both of Tokyo; Takeyuki Naito; Masato Onodera, both of Yokohama; Kouji Saito, Tokyo, all of Japan

[73] Assignee: Ebara Manufacturing Co., Ltd., Tokyo, Japan

[21] Appl. No.: 778,551

[22] Filed: Mar. 17, 1977

[30] Foreign Application Priority Data

| | | | |
|---|---|---|---|
| Mar. 17, 1976 | [JP] | Japan | 51-28987 |
| Mar. 17, 1976 | [JP] | Japan | 51-28988 |
| May 18, 1976 | [JP] | Japan | 51-57135 |
| Dec. 27, 1976 | [JP] | Japan | 51-156345 |
| Dec. 27, 1976 | [JP] | Japan | 51-156346 |
| Dec. 27, 1976 | [JP] | Japan | 51-156347 |

[51] Int. Cl.[2] ..... D21C 11/02

[52] U.S. Cl. ..... 162/36; 423/207; 423/512 A; 423/DIG. 3

[58] Field of Search ..... 423/207, DIG. 3, 512 A; 162/30 R, 35, 36, 47

[56] References Cited

U.S. PATENT DOCUMENTS

| | | | |
|---|---|---|---|
| 2,640,758 | 6/1953 | Aries et al. | 162/36 |
| 2,642,399 | 6/1953 | Aries et al. | 423/DIG. 3 |
| 2,993,753 | 7/1961 | Collins | 162/36 |
| 3,043,655 | 7/1962 | Green et al. | 162/30 R |
| 3,183,145 | 5/1965 | Collins | 162/47 |
| 3,549,484 | 12/1970 | Hojnos et al. | 162/36 |
| 3,698,860 | 10/1972 | Shiba | 423/512 A |

OTHER PUBLICATIONS

Handbook of Pulp and Paper Technology, Britt, p. 195, 1964.

*Primary Examiner*—S. Leon Bashore
*Assistant Examiner*—Peter F. Kratz
*Attorney, Agent, or Firm*—Oblon, Fisher, Spivak, McClelland & Maier

[57] ABSTRACT

A process for recovery of chemicals from a sodium sulfite pulping waste liquor is disclosed in which a smelt obtained from the waste liquor is introduced into an aqueous slurry containing solidified smelt while make up water and a weak aqueous slurry are supplied to effect incomplete dissolution of the smelt into the aqueous slurry to maintain the content of total solid and the temperature of the slurry at constant levels, the resulting aqueous slurry is subjected to a solid-liquid separation to obtain a wet cake having the molar ratio of $S/Na_2O$ substantially equal to that of the smelt, the wet cake is mixed with hot particles of sodium carbonate and sodium sulfite while hot air is supplied to effect oxidation of sodium sulfide in the wet cake to sodium sulfite and then the oxidized product is dissolved in aqueous medium and sulfur dioxide-containing gas, preferably the exhaust gas from the recovery boiler, is contacted with the resulting aqueous solution to convert sodium carbonate into sodium sulfite, whereby the overall process is carried out in a closed system and the sulfur component and the sodium component present in the waste cooking liquor are recovered and regenerated into a cooking liquor.

17 Claims, 1 Drawing Figure

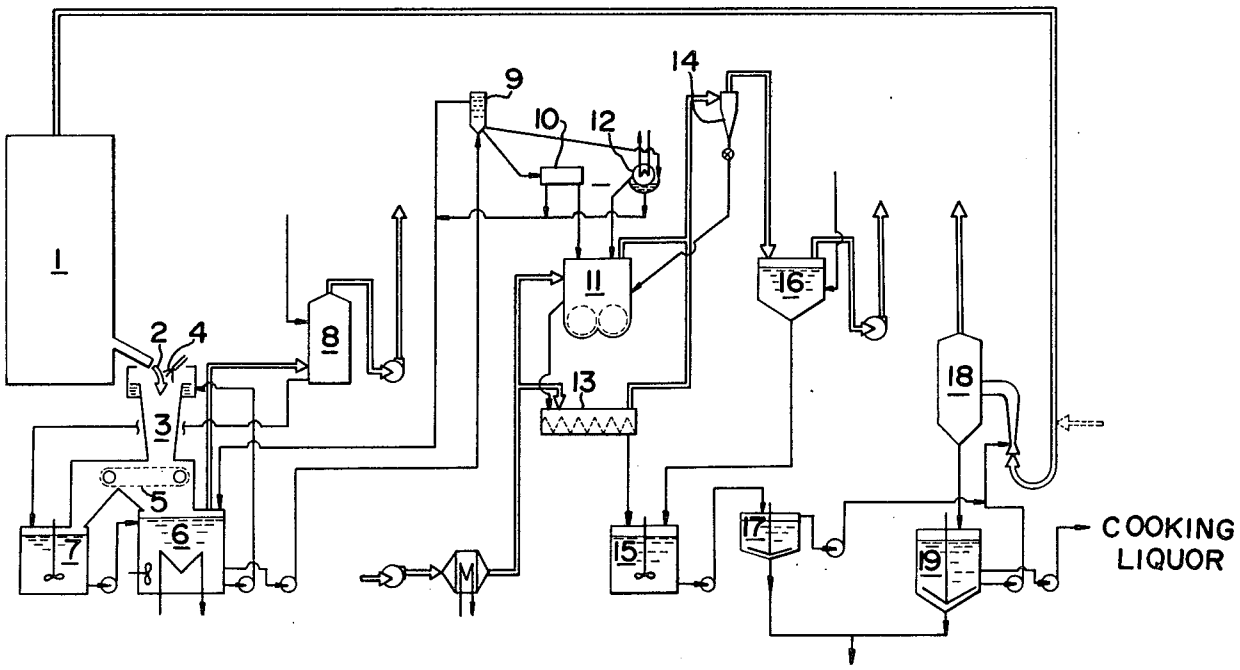
COOKING LIQUOR
1
2
3
4
5
6
7
8
9
10
11
12
13
14
15
16
17
18
19

PROCESS FOR RECOVERY OF CHEMICALS FROM PULPING WASTE LIQUOR

BACKGROUND OF THE INVENTION

1. Field of the Invention

This invention relates to a process for recovery of chemicals from a pulping waste liquor, and more particularly to a process for recovery of chemicals from a smelt which is obtained by combustion of concentrated pulp cooking waste liquor containing a sulfite or a bisulfite.

2. Description of the Prior Art

Various processes for producing pulp from cellulosic material, for example, wood chips have been practiced. Among them, more interest has recently been drawn to a process in which the cooking chemicals are sodium sulfite or sodium bisulfite in combination with sodium carbonate, because cellulosic pulp is produced in high yield to make the process economical. However, in this process no effective commercial recovery system of chemicals from the waste liquor has been established.

In Japanese Patent Publication 14401/74, we proposed a system for recovery of chemicals comprising concentrating a cooking waste liquor from sodium sulfite process, burning the concentrate to obtain a smelt mainly comprising sodium sulfide and sodium carbonate, oxidizing the smelt with air to convert sodium sulfide into sodium sulfite, dissolving the oxidized material in water and treating the resulting aqueous solution with a sulfur dioxide-containing gas to convert sodium carbonate into sodium sulfite, thereby regenerating an aqueous solution which can be used as a cooking liquor in the pulping process.

Although this prior process deals with a fundamental, technical concept for recovering chemicals from sulfite pulping waste liquor, there are still many problems to be solved. For example, the smelt contains, in addition to sodium sulfide and sodium carbonate, a small amount of sodium sulfate and slight amounts of sodium thiosulfate, sodium sulfite and sodium chloride, some of which are hard to convert into the desired chemicals, and the proportion of various chemicals present in the smelt may vary over a wide range depending upon the cooking conditions employed in the particular pulp mill; accordingly, it is difficult to standardize the conditions under which the recovery of chemicals is practiced and to design an apparatus suitable for carrying out the process.

Accordingly, an object of this invention is to provide a process for recovery of chemicals from sulfite pulping waste liquor without causing environmental pollution and any appreciable loss of chemicals.

When a typical waste liquor from semichemical sulfite process is concentrated and burned, the resulting smelt has the following composition ranges (by weight):

$Na_2S$: 30 to 40%
$Na_2CO_3$: 45 to 60%
$Na_2SO_4$: 5 to 10%
$Na_2S_2O_3$: 0–5%
others: 2–4%

It has already been known that, when smelt is treated with a molecular oxygen-containing gas in the presence of water, the sodium sulfide and sodium sulfite are oxidized according to the following reaction formulae:

$$2Na_2S + 3O_2 \rightarrow 2Na_2SO_3 \quad (1)$$

$$Na_2S + 2O_2 \rightarrow Na_2SO_4 \quad (2)$$

$$Na_2SO_3 + \tfrac{1}{2} O_2 \rightarrow Na_2SO_4 \quad (3)$$

$$2Na_2S + H_2O + 2O_2 \rightarrow Na_2S_2O_3 + 2NaOH \quad (4)$$

Reaction (1) occurs at a relatively low temperature and reactions (2) and (3) at relatively high temperature.

In addition to the reactions mentioned above, the following side reactions concurrently occur:

$$Na_2S_2O_3 + 2NaOH \rightarrow \tfrac{3}{4} Na_2SO_3 + \tfrac{3}{8} Na_2S + H_2O \quad (5)$$

$$Na_2S_2O_3 + 2NaOH + O_2 \rightarrow 2Na_2SO_3 + H_2O \quad (6)$$

On the other hand, the sodium carbonate which is one component of the smelt is unchanged during the oxidation treatment.

Thus, in general, such oxidation treatment involves various reactions and the primary purpose is to convert the sodium sulfide into sodium sulfite and to prevent the formation of sodium sulfate and sodium thiosulfate which are inactive in the pulping process. However, in practice, it is difficult to control the oxidation treatment to such an extent that only the desired reaction (1) will occur.

Further, an aqueous solution of the oxidized product is treated with a sulfur dioxide-containing gas to convert the sodium carbonate into sodium sulfite. The source of said sulfur dioxide is, in general, an exhaust gas from the recovery boiler and substantially all of the sulfur dioxide released during the combustion of concentrated waste liquor is recovered by being absorbed in the aqueous solution to regenerate a cooling liquor whereby the overall process can be operated as a closed system.

Accordingly, in order to successfully carry out the process, it is essential that, in the mixture to be oxidized, the molar ratio of $S/Na_2O$ be maintained substantially equal to that of the smelt and the water content be kept at an appropriate level.

In general, the temperature at which the oxidation is effected is controlled by adjusting the amount of water contained in the reaction mixture, consequently, by adjusting the amount of heat removed from the mixture by evaporation of water, so that the reaction temperature is maintained within a range within which sodium sulfide is effectively converted into sodium sulfite.

SUMMARY OF THE INVENTION

According to this invention, the molar ratio of $S/Na_2O$ in the reaction mixture is readily controlled by adjusting the amount of aqueous slurry to be supplied to a solid-liquid separation step and the water content of the wet cake to be oxidized and by establishing the balance between the make up water to be supplied to the aqueous slurry and the amount of water lost from the system, mainly by evaporation in the smelt hopper and the oxidizers.

According to this invention, there is provided a process for recovery of chemicals from sodium sulfite pulping waste liquor comprising steps of:

(1) introducing a smelt obtained by burning a concentrated waste liquor into an aqueous slurry while supplying make up water and a weak aqueous slurry recycled from step (2) to effect incomplete dissolving of the smelt into the aqueous slurry and supplying a part of the resulting aqueous slurry to step (2) thereby maintaining the aqueous slurry to a total solid content of from about 35 to about 70% by weight, a proportion of sodium carbonate in the total solid material lower than that of the smelt and a temperature of from about 55° to about 90° C., (2) separating the slurry formed in step (1) into a wet cake containing water in a proportion of from about 10 to about 50% by weight and having a molar ratio of $S/Na_2O$ substantially equal to that of the smelt and a weak aqueous slurry, and recycling the weak slurry to step (1), and (3) mixing the wet cake with hot particles containing sodium sulfite and sodium carbonate while supplying simultaneously a molecular oxygen-containing gas to effect oxidation of sodium sulfide present in the wet cake into sodium sulfite.

DETAILED DESCRIPTION OF THE PREFERRED EMBODIMENTS

This invention will be explained in detail.

First Step

A smelt which is formed in conventional recovery boiler by combustion of a concentrated pulping cooking waste liquor is discharged to smelt receiving means comprising a smelt hopper and a screen. Against thesmelt stream directed into the hopper, a steam or air jet is impinged to cool and divide out the smelt into solid particles. An aqueous slurry recycled from a circulating tank is flowed downwardly on the internal surface of the hopper to remove the particles attached thereto. The solid particles drop onto a conveying screen provided below the hopper to separate lumps or large particles from smaller particles, the former being supplied to a green liquor tank in which the lumps are dissolved in an aqueous medium introduced from a gas washer and the latter being supplied to a slurry circulating tank.

The atmosphere of the smelt hopper is maintained under a reduced pressure by means of an air fan which discharges the air in the hopper to the atmosphere after being treated in a gas washer, and the air passing through the hopper effects oxidation of a part of the sodium sulfide present in the smelt and the recycled slurry into sodium thiosulfate. (Hereunder this is referred to as preliminary oxidation.)

The circulating tank to which solidified smelt particles are supplied, contains a large amount of the aqueous slurry to which simultaneously a weak green liquor and/or a weak aqueous slurry recycled from the second step are supplied thereby effecting partial or incomplete dissolving of the chemicals in the aqueous slurry. By "partial or incomplete dissolving", we mean a state in which the final mixture of the chemicals and the aqueous medium contains some undissolved solid material, so that the formation of a slurry by precipitating solid particle from an aqueous solution with cooling or from an aqueous supersaturated solution is also within this meaning.

The temperature of the aqueous slurry is maintained at from 55° to 90° C., preferably 75° to 83° C. by a cooling means, for example, a cooling coil or jacket provided in the tank.

The substantial portion of the slurry is recycled to the smelt hopper and the remainder is supplied to the subsequent step of solid-liquid separation after which the separated liquid phase is recycled to the slurry circulating tank.

The amount of slurry to be recycled to the smelt hopper is from 20 to 200 times, preferably about 100 times based on the weight of smelt introduced from the recovery boiler. Thus, the amount of aqueous slurry hold in the circulating tank is an extremely large amount in comparison with the amount of the smelt introduced and the residence time of the aqueous slurry in the tank is usually more than 20 hours.

The slurry is composed of a solid phase the main component of which is sodium carbonate and a liquid phase the main component of which is an aqueous sodium sulfide. In consequence, the liquid phase recycled from the second step contains mainly sodium sulfide. Therefore, at steady state, the proportion of sodium carbonate present in the slurry is maintained at a constant level lower than that of the smelt and the content of total solid in the slurry is from 35 to 70% preferably 45 to 60%, by weight, the total solid being the sum of chemicals present in the slurry as solute and solid particles undissolved as well as in soluble materials.

Second Step

The slurry is pumped from the circulating tank to a solid-liquid separator, for example, a screw decantor at a constant flow rate and a constant feed pressure through a head tank. In the separator, the slurry is separated into a wet cake which comprises solid sodium carbonate and an aqueous sodium sulfide and contains water of from 10 to 50%, preferably 15 to 35% by weight, and a weak aqueous slurry which comprises the aqueous sodium sulfide and microparticles not separated. The wet cake is supplied to the subsequent oxidation step and the weak aqueous slurry is recycled to the circulating tank.

In order to carry out the overall process according to this invention satisfactorily, it is essential to control the molar ratio of $S/Na_2O$ in the wet cake to be substantially equal to that of the smelt, and this can be done by adjusting appropriately the amount of aqueous sodium sulfide to be present in the cake.

However, in some cases, depending upon the cooking conditions and properties of the pulp to be produced, the proportion of sodium carbonate in the cooking chemicals is small, for example, less than 10% by weight; then the sodium sulfide content of the smelt increases to above 40% by weight. Thus, it is necessary that the wet cake contains a higher proportion of sodium sulfide in order to achieve the required level of the molar ratio of $S/Na_2O$; this naturally means that the liquid phase in the wet cake must have a concentration of sodium sulfide if the amount of the aqueous sodium sulfide is relatively small, or that the proportion of the liquid phase must be increased, if the concentration is relatively low.

In order to achieve a high concentration of sodium sulfide, the temperature of the aqueous slurry must be raised in order to avoid undesirable precipitation of sodium sulfide on various parts, especially on the cooling means, since the solubility of sodium sulfide in water decreases at lower temperature. At a high temperature, especially above 85° C., aqueous sodium sulfide is extremely corrosive and at such a high temperature even 18–8 stainless steel cannot resist and more expensive non-corrosive material will be required. On the other hand, if the liquid phase is of low concentration, the wet cake must contain a relatively large amount of liquid phase in order to achieve required molar ratio of $S/Na_2O$. However, the screw decantor which is usually employed in this invention can not perform successfully if a relatively dilute wet cake is intended, accordingly, at the solid content at which the wet cake is readily obtainable, the amount of sodium sulfide contained in the wet cake is too low.

For the foregoing reasons, when the smelt has a higher proportion of sodium sulfide, it is difficult to increase the amount of liquid phase in the wet cake in order to achieve the required molar ratio of $S/Na_2O$ so that the process may easily proceed and additional sodium sulfide must be supplied to the oxidation reaction mixture.

One feature of the process according to this invention is that solid material obtained by contacting a portion of the aqueous slurry discharged from the first step and/or a portion of the weak aqueous slurry recovered from the solid-liquid separator with a cooling surface, is supplied to the oxidation step thereby adjusting the molar ratio of $S/Na_2O$ of the reaction mixture to be oxidized to that of the smelt.

Such cooling surface may conveniently be a drum flaker comprising an aqueous slurry receiving vat, a rotary drum positioned in the vat and so arranged that the lower part thereof is immersed in the slurry, a cooling means to maintain the drum at a temperature below the solidifying temperature of the aqueous slurry and a doctor means for removing the solidified material from the drum surface.

Third Step

The filter cake recovered in the second step and, if necessary, additional solid material obtained from the drum flaker and continuously supplied to an oxidation reactor in which the feed is thoroughly admixed with hot particles of sodium carbonate and sodium sulfide at an elevated temperature under agitation while a molecular oxygen-containing gas is passed therethrough to oxidize sodium sulfide present in the feed to sodium sulfite. The oxidation reactor is conveniently a double-shaft Z type kneader having a feeding port and an overflow chute for discharging the oxidized product.

In the kneader, the shaft adjacent to the overflow chute is rotated at a speed of 10 to 50 r.p.m. and higher by 10 to 20% than that of the other shaft to facilitate the discharge of the oxidized product. The oxidized product is obtained in the form of particles having a diameter of, for example, from 200 to 400$\mu$ depending upon the resident time.

Depending upon the oxidation conditions and the composition of the feed to be oxidized, a relatively small amount of unoxidized sodium sulfide may be present in the oxidation product. In such case, the product is subjected to additional oxidation in which the product is passed through a confined space in a piston flow while a molecular oxygen-containing gas is supplied simultaneously.

During the main oxidation and the suboxidation, sodium sulfide and sodium thiosulfate are oxidized to sodium sulfite. The molecular oxygen-containing gas is oxygen or air, the latter being preferred.

The amount of the molecular oxygen-containing gas to be supplied to the main oxidation step is from 2 to 20 times, preferably 10 times, in terms of oxygen required for completely oxidize the sodium sulfide the amount of which is based on the amount in the smelt, since some of the sodium sulfide in the smelt has been converted into other compounds, for example, such as sodium thiosulfate, and the exact amount thereof in the reaction mixture is difficult to determine. The temperature of the reaction mixture rises by the heat generated in the oxidation reaction. At a high temperature, for example, above about 300° C., undesirably large amount of sodium sulfate will be formed; on the other hand, at a lower temperature, for example, below 100° C., sodium sulfide is not completely converted into sodium sulfite rather the formation of sodium thiosulfate increases.

The heat of reaction in converting sodium sulfide into sodium sulfite is 171 K cal. per one mole of sodium sulfide and that of sodium sulfide into sodium thiosulfate is 112 K cal. per one mole of sodium sulfide. Thus, it is beneficial to effect a preoxidation of the smelt in order to prevent the temperature from rising unduly during the oxidation reaction. The temperature of the reaction mixture to be oxidized is held to an appropriate level by adjusting the water content of the wet cake, and additional water may be supplied to the oxidation reactor, if necessary.

The oxidation reaction is carried out at a temperature of from 100° to 300° C., preferably 150° to 250° C., for 2 to 15 hours, preferably 3 to 6 hours with the supply of a molecular oxygen-containing gas at 100° to 200° C., preferably 150° to 180° C.

In the case where the suboxidation reaction is effected, the molecular oxygen-containing gas is supplied in an amount of from 10 to 30% used for the main oxidation.

In the reactions (5) and (6) mentioned above, sodium hydroxide is required; this will be supplied from the reaction (4) in stoichiometric quantity. If any shortage of sodium hydroxide is observed, an additional amount may be supplemented. Residual sodium sulfide is often observed in the oxidation product due to the shortage of water, especially in the suboxidation reactor; in this case water may be added to the reaction mixture.

Fine particles which are entrained in the exhaust gas from the main oxidation and the suboxidation reactors are collected in a dust collector such as cyclone and recycled to any of the reactors. The exhaust gas thus treated is further cleaned in a scrubber, if necessary, to completely remove the fine particles entrained.

Fourth Step

The oxidized product is continuously supplied to a dissolving tank to which washed water discharged from the scrubber is simultaneously supplied or fresh water to form an aqueous solution containing sodium carbonate and sodium sulfite at a concentration of from about 15 to about 25% by weight and having a temperature of above about 30° C. The aqueous solution is allowed to stand to effect sedimentation of insoluble materials including carbon and iron compound, which are then removed by, for example, a thickener. Since such insoluble materials catalytically promote the oxidation of sodium sulfite into undesirable sodium sulfate in the subsequent step.

Into the aqueous solution thus clarified, the exhaust gas discharged from the recovery boiler which contains sulfur dioxide formed by combustion of the black liquor is blown to form sodium sulfite by the reaction of sodium carbonate and sulfur dioxide. If necessary, the exhaust gas from an auxiliary boiler is used together with the recovery boiler exhaust gas. Such exhaust gas often contains a relatively large amount of sulfur trioxide which reacts with sodium carbonate to form undesirable sodium sulfate and therefore, in such a case, precaution must be taken to remove sulfur trioxide by washing with water.

The resulting aqueous solution contains sodium sulfite and sodium carbonate in a proportion and at concentrations suitable for use in a pulp making process.

Fifth Step

Since the aqueous solution obtained contains solid particles which are accompanied with the exhaust gas, the aqueous solution is treated with a thickener to remove sludge.

This sludge and the sludge recovered in the fourth step contain a relatively large amount of aqueous solution of sodium salts. Both sludges are combined and mixed with water. From the resulting mixture, the aqueous solution containing useful chemicals is separated by a thickener and a filter and is recycled to the first step and/or the fourth step to use for dissolving the smelt and/or the oxidation product.

As mentioned above, according to this invention the overall process is operated as a closed system in which the sulfur dioxide generated in the recovery boiler and present in the exhaust gas is absorbed in the aqueous solution which contains substantially all of the sodium component and sulfur component present in the smelt as sodium carbonate and sodium sulfite, and little or no loss of chemicals will occur.

The FIGURE illustrates the process according to this invention.

Concentrated black liquor is burned in recovery boiler 1 to form a smelt which is supplied continuously in the form of stream 2 to smelt hopper 3. Steam or high pressure air stream 4 is directed to the smelt stream to effect cooling and dividing out of the smelt into fine particles. An aqueous slurry recycled from circulating tank 6 is flowed downwardly on the inner surface of the hopper to prevent accumulation of smelt thereon. The rate of the slurry to be supplied to the hopper is 100 times that of the smelt, by weight. The smelt particles drop on conveying screen 5 by which fine particles and large particles are separated, the former being supplied to the slurry circulating tank 6 and the latter to green liquor tank 7.

In the green liquor tank, the large particles are dissolved under agitation in water, which is supplied from scrubber 8 for washing exhaust gas from the hopper, to form a weak green liquor which is pumped to the slurry circulating tank.

Though the concentration of the green liquor produced varies depending upon the amount of water to be supplied, which is determined taking in account the total water balance throughout the overall operation, the concentration is a factor in determining the concentration of slurry to be formed in the slurry circulating tank and is usually maintained at about 10% by weight.

Under steady operation conditions, a well established balance of water between (1) the sum of the supply to oxidation step and the water discharged together with air from the smelt hopper and (2) water supplied from the green liquor tank is maintained to make the solid content in the green liquor tank at a constant level.

The green liquor is mixed in the slurry circulating tank with the aqueous slurry, the solidified smelt particles and a weak aqueous slurry recycled from the second step under agitation, to form a slurry comprising a multi-component aqueous phase containing mainly sodium sulfide as well as sodium hydroxide, sodium polysulfides and other sodium salts such as sodium thiosulfate, sodium sulfate, sodium carbonate and sodium chloride and a solid phase containing mainly sodium carbonate and other undissolved components above and various derivatives therefrom.

The molar ratio of $S/Na_2O$ of total solid in the slurry is considerably higher than that of the smelt, for example, the ratio of smelt being about 0.5 the ratio of slurry being from 0.8 to 1.0. The temperature of the slurry is maintained at from 55° to 90° C., preferably 75° to 83° C., for example, by means of cooling water passing through a cooling coil or jacket and maintained at a temperature from 5° to 40° C., preferably 10° to 20° C., lower than that of the slurry.

The use of cooling water of too low temperature results in the precipitation of solid on the cooling surface to impede cooling efficiency. If desired, cooling by passing cold air through the slurry may be used in addition to such water cooling. In this case, some of the sodium sulfide is oxidized.

The total content of the chemicals in the slurry is maintained within a range of from 35 to 70%, preferably 45 to 60% by weight.

At a concentration below 35%, though cooling efficiency is improved, the wet cake obtained in the second step contains more sodium carbonate than required for maintaining the desired molar ratio of $S/Na_2O$. Further, if the slurry or the filtrate is cooled on a drum flaker, there is insufficient solidification, or the resultant flakes contain too much water which lowers the oxidation temperature in the oxidation reactor to which the flakes are supplied.

On the other hand, at a concentration above 70%, there are disadvantages in that it becomes more difficult to maintain the slurry temperature below 90° C. and there is clogging of the pipe lines.

The slurry is pumped via head tank 9 to screw decantor 10. With the provision of the head tank, the slurry can be supplied continuously at a constant pressure to the decantor. By the decantor, a part of the solid phase is separated and removed as a wet cake from the aqueous slurry and the wet cake is supplied to oxidation reactor 11 while the remainder is recycled to the slurry circulating tank as a weak aqueous slurry.

In the case where the smelt has a proportion of sodium sulfide less than 40%, especially less than 30%, by weight, it is easy to adjust the molar ratio of $S/Na_2O$ of the wet cake to that of the smelt.

On the other hand, if the proportion of sodium sulfide in the smelt increases to more than 30%, especially more than 40% by weight, it is naturally necessary to increase the proportion of sulfur component in the aqueous slurry in order to adjust the $S/Na_2O$ ratio of the wet cake to that of the smelt. If the concentration of sodium sulfide in the aqueous slurry increases, the cooling efficiency of the slurry is reduced due to the precipitation of sodium sulfide on the cooling surface, then, it is difficult to lower the temperature of the aqueous slurry to the required level. In such a case, part of the slurry discharged from the head tank is divided out and directed to drum flaker 12; alternatively a part of the filtrate from the decantor is directed to the drum flaker.

By the drum flaker, the chemicals present in the slurry or the filtrate are solidified on the drum which is usually cooled to a temperature below 70° C., preferably 30° to 50° C. and the flakes formed are removed and supplied to the main oxidation reactor.

The flakes have a composition similar to that of the aqueous slurry supplied. For easy operation of the drum flaker, it is preferred to solidify only a part of the aqueous slurry and to recycle the remaining aqueous slurry to the circulating tank. Thus, by controlling the amount of flakes supplied to the reactor, the molar ratio of $S/Na_2O$ of the combined filter cake and flake is readily adjusted to that of the smelt.

The main oxidation reactor is a double-shaft Z type kneader the lower portion of which contains a large amount of solid particles of the oxidized product containing a small amount of water of, for example, a few percents and up to 5% by weight. As the wet cake and the flake are supplied to the reactor, they are immediately mixed with the oxidized product particles, while hot air (100° to 200° C., preferably 150°-185° C.) is simultaneously supplied. Since the exhaust gas from the reactor contains a considerable amount of moisture, if too small an amount of air is supplied, the exhaust gas becomes to have a higher moisture content which results in water droplets condensing on the surface of various parts, for example, cyclone separator and duct. Such droplets catch fine particles entrained in the exhaust gas and cause clogging. The supplied air also facilitates agitation and mixing of the reaction mixture in the reactor; therefore, an adequate air supply is desirable. However, too much air requires more energy for heating and supplying air, and in addition causes the escape of a large amount of particles from the reactor. Thus, the amount of air to be supplied is from 2 to 20 times, preferably 10 times that required to completely oxidize the total sodium sulfide present in the smelt.

The exhaust gas from the reactor is fed to cyclone 14 in which particles entrained are recovered and recycled to the reactor.

The oxidized product which contains unoxidized chemicals and oxidation intermediates is discharged from the reactor via the overflow chute and is supplied to suboxidation reactor 13.

The purpose of the suboxidation reactor is to effect as complete an oxidation reaction as possible. If such unoxidized chemicals and intermediates are introduced in the subsequent step, they react with sulfur dioxide to form hydrogen sulfide which is a pollutant gas and sodium thiosulfate which is undesirable for pulp making.

To the suboxidation reactor, air is introduced to effect additional oxidation at a temperature of from 100° to 300° C., preferably 150° to 250° C. The water, up to about 5% by weight, present in the solid particles discharged from the main reactor is enough for performing the conversion of residual sodium sulfide into sodium sulfite. However, if less amount of water is present, an additional water may be fed in order to facilitate the oxidation reaction. The exhaust gas from the suboxidation reactor is supplied to the cyclone 14 in which entrained solid particles are recovered.

If the entrained particles are not completely separated in the cyclone, then the exhaust gas is further treated in scrubber 16 to which fresh water or a dilute aqueous chemical solution is supplied to dissolve solid particles as completely as possible.

The oxidized product is discharged from the suboxidation reactor and supplied to dissolving tank 15 to which the aqueous solution discharged from the scrubber 16 is supplied to form an aqueous solution containing sodium carbonate and sodium sulfite.

The amount of aqueous solution to be supplied to the dissolving tank is controlled so that the concentration of the resulting aqueous solution is about 20% by weight. At a concentration above 20%, there is encountered difficulty in treating the aqueous solution with sulfur dioxide for producing a pulp cooking liquor; on the other hand too dilute an aqueous solution cannot give a liquor having a concentration suitable for cooking.

The aqueous solution is supplied to sediment tank 17 in which insoluble material is separated as sludge, and the clarified liquor is supplied to absorber 18.

In the absorber, the clarified liquor and the exhaust gas discharged from the recovery boiler are intimatedly contacted to effect conversion of sodium carbonate into sodium sulfite to the extent required for the desired cooking liquor composition. The exhaust gas from the absorber does not contain sulfur dioxide and is vented to atmosphere.

The cooking liquor thus produced is clarified in thickener 19 and used for pulp making. The sludge recovered from the thickener is combined with the sludge from the sediment tank, washed with water, filtered and removed from the processing system. The washing and the filtrate are recycled to the scrubber and/or the dissolving tank.

This invention will be explained by means of Examples. However, it should be understood that this invention is in no way limited by these Examples.

EXAMPLE 1

Smelt recovered from a recovery furnace was treated according to the procedures explained above and using the apparatus illustrated by referring to FIG. 1 to produce a cooking liquor. The temperature and the content of total chemicals in the slurry circulating tank 6 were maintained at 83.5° C. and 59.6% by weight, respectively. In the second step, the screw decantor 9 was used but not the drum flaker 11. The temperatures of the reaction mixtures in the main oxidation reactor 10 and the suboxidation reactor 13 were maintained at 190° C. and 150° C., respectively.

The smelt was introduced in the process at a rate of 2.0 tons per hour and fresh water was supplied at 24 tons per hour.

The composition in each step is given in Table 1.

Table 1

| | 1st | | 2nd | 3rd | | | 4th |
|---|---|---|---|---|---|---|---|
| wt % | Smelt | Slurry | Wet Cake | Main oxidation product | Sub-oxidation product | Conversion (%) | Cooking liquor |
| $Na_2S$ | 32.6 | 34.8 | 14.5 | 2.0 | 0.8 | | 0 |
| $Na_2CO_3$ | 61.2 | 35.6 | 66.8 | 53.4 | 51.6 | | 4.2 |
| $Na_2SO_3$ | 0.8 | — | — | 33.9 | 38.0 | 85.2 | 83.1 |
| $Na_2S_2O_3$ | 0.5 | 13.6 | 9.1 | 3.4 | 1.6 | | 3.7 |
| $Na_2SO_4$ | 3.5 | 7.6 | 6.4 | 6.1 | 6.8 | | 7.7 |
| $S_{x-1}$ | — | 6.2 | 1.9 | | — | | — |
| NaCl | 1.4 | 2.6 | 1.3 | 1.2 | 1.2 | | 1.3 |
| Total solid | | 59.6 | 77.1 | | | | 20.8 |
| $S/Na_2O$ | 0.443 | 0.933 | 0.443 | 0.443 | 0.443 | | 0.978 |

Table 1-continued

| | 1st | | 2nd | 3rd | | | 4th |
|---|---|---|---|---|---|---|---|
| wt % | Smelt | Slurry | Wet Cake | Main oxidation product | Sub-oxidation product | Conversion (%) | Cooking liquor |
| | | | | | | | pH = 7.3 |

EXAMPLE 2

Procedures similar to those of Example 1 were repeated.

The slurry in the circulating tank had a temperature of 78° C. and total chemical of 55.1%. In the second step, the screw decantor and the drum flaker were used. The temperature of the main oxidation reactor and the suboxidation reactor were 210° C. and 160° C., respectively. The amount of water introduced to the suboxidation reactor was 50 liters per hour.

The compositions in each step is given in Table 2.

Table 2

| wt % | Smelt | Slurry | Wet Cake | Flake | Main oxidation product | Suboxidation product | Conversion (%) | Cooking liquor |
|---|---|---|---|---|---|---|---|---|
| $Na_2S$ | 43.8 | 42.1 | 18.0 | 44.2 | 2.1 | 0.9 | | 0 |
| $Na_2CO_3$ | 50.6 | 32.8 | 63.8 | 30.3 | 42.2 | 40.9 | | 3.9 |
| $Na_2SO_3$ | 0.5 | — | — | — | 44.5 | 47.6 | 85.0 | 82.6 |
| $Na_2S_2O_3$ | 0.4 | 12.5 | 9.3 | 13.9 | 3.6 | 2.3 | | 4.2 |
| $Na_2SO_4$ | 3.0 | 4.6 | 6.7 | 4.4 | 6.2 | 6.9 | | 7.9 |
| $S_{x-1}$ | — | 5.1 | 1.0 | 4.3 | — | — | | — |
| NaCl | 1.7 | 2.9 | 1.2 | 2.9 | 1.4 | 1.4 | | 1.4 |
| Total solid | | 55.1 | 73.8 | 54.3 | | | | 21.0 |
| $S/Na_2O$ | 0.556 | 0.926 | 0.455 | 0.934 | 0.556 | 0.556 | | 0.987 |
| | | | | | | | | pH = 7.2 |

What is claimed is:

1. A process for recovery of chemicals from sodium sulfite pulping waste liquor comprising the steps of:

(1) introducing and incompletely dissolving a smelt, obtained by burning a concentrated waste liquor and containing mainly sodium sulfide and sodium carbonate, in a large body of aqueous slurry, which comprises a solid phase the main component of which is sodium carbonate and a liquid phase the main component of which is aqueous sodium sulfide, adding to said body make up water and a weak aqueous slurry recycled from step (2), and supplying a portion of the resulting aqueous slurry to step (2), maintaining the total solid content of said body of aqueous slurry at from about 35 to about 70% by weight, the proportion of sodium carbonate in the total solid material at lower than that of the smelt, and the temperature at from about 55° to about 90° C.

(2) separating the slurry supplied from step (1) into (a) a wet cake containing water in a proportion of from about 10 to about 50% by weight and (b) a weak aqueous slurry, recycling said weak slurry (b) to step (1), and supplying said wet cake (a) to step (3), and (3) mixing a feed consisting of said wet cake (a) and sufficient additional solid material to adjust the total molar ratio of $S/Na_2O$ of said feed to that of said smelt with hot particles containing sodium sulfite and sodium carbonate while supplying simultaneously a molecular oxygen-containing gas to effect oxidation of sodium sulfide present in said feed into sodium sulfite, wherein said additional solid material is obtained by contacting at least one of a portion of said slurry supplied to step (2) and a portion of said weak aqueous slurry (b) obtained in step (2) with a cooled surface to obtain said solid material.

2. A process for recovery of chemicals according to claim 1, wherein in the step (1) said body of aqueous slurry is circulated between a smelt receiving means and a smelt dissolving means, and said smelt is introduced into said aqueous slurry in said smelt receiving means.

3. A process for recovery of chemicals according to claim 2, wherein the amount of the circulating slurry is from 20 to 200 times by weight that of the smelt introduced in the receiving means.

4. A process for recovery of chemicals according to claim 2, wherein said weak aqueous slurry recycled from step (2), and said make up water are added to said body in said smelt dissolving means.

5. A process for recovery of chemicals according to claim 1, wherein said smelt is impinged with an air or steam stream to effect cooling and dividing out into particles.

6. A process for recovery of chemicals according to claim 2, wherein said smelt receiving means comprises a smelt hopper and a screening means, and wherein lumps remaining after said smelt is introduced into said smelt hopper through which is circulating said body of aqueous slurry are separated from smaller solidified smelt particles by said screening means and said separated lumps are separately dissolved in make up water to form a weak green liquor.

7. A process for recovery of chemicals according to claim 1, wherein said make up water is a weak green liquor.

8. A process for recovery of chemicals according to claim 1, wherein said make up water is wash water recovered from a means for washing an exhaust gas from the smelt receiving means.

9. A process for recovery of chemicals according to claim 1, wherein said aqueous slurry is cooled by means of cooling water having a temperature by 5° to 40° C. lower than that of the slurry.

10. A process for recovery of chemicals according to claim 1, wherein the amount of said molecular oxygen-containing gas to be supplied to the oxidation reaction is from 2 to 20 times that required to completely oxidize the sodium sulfide present in the smelt into sodium sulfite.

11. A process for recovery of chemicals according to claim 1, wherein the temperature of said molecular oxygen-containing gas to be supplied to the oxidation reaction is from 100° to 200° C.

12. A process for recovery of chemicals according to claim 1, wherein the temperature of the reaction mixture to be oxidized is from 100° to 300° C.

13. A process for recovery of chemicals according to claim 1, wherein sodium hydroxide is added to the reaction mixture to be oxidized.

14. A process for recovery of chemicals according to claim 1, wherein at least one of a part of said aqueous slurry and a part of said weak aqueous slurry are supplied to the reaction mixture to be oxidized.

15. A process for recovery of chemicals according to claim 1, wherein said oxidation reaction is effected in two stages, the first stage being mixing said wet cake with said hot particles while supplying said molecular oxygen-containing gas to form an oxidized product in the form of particles, and a second stage being contact of said oxidized product particles and a molecular oxygen-containing gas within a confined space.

16. A process for recovery of chemicals according to claim 1, wherein at least one of said smelt, and said aqueous slurry formed in step (1) are contacted with a molecular oxygen-containing gas to effect preliminary oxidation of the sodium sulfide.

17. A process for recovery of chemicals from sodium sulfite pulping waste liquor comprising the steps of:

(1) introducing and incompletely dissolving a smelt, obtained by burning a concentrated waste liquor and containing mainly sodium sulfide and sodium carbonate, in a large body of aqueous slurry, which comprises a solid phase the main component of which is sodium carbonate and a liquid phase the main component of which is aqueous sodium sulfide, adding to said body make up water and a weak aqueous slurry recycled from step (2), and supplying a portion of the resulting aqueous slurry to step (2), maintaining the total solid content of said body of aqueous slurry at from about 35 to about 70% by weight, the proportion of sodium carbonate in the total solid material at lower than that of the smelt, and the temperature at from about 55° to about 90° C.

(2) separating the slurry supplied from step (1) into (a) a wet cake containing water in a proportion of from about 10 to about 50% by weight and (b) a weak aqueous slurry, recycling said weak slurry (b) to step (1), and supplying said wet cake (a) to step (3), and (3) mixing a feed consisting of said wet cake (a) and sufficient additional solid material to adjust the total molar ratio of $S/Na_2O$ of said feed to that of said smelt with hot particles containing sodium sulfite and sodium carbonate while supplying simultaneously a molecular oxygen-containing gas to effect oxidation of sodium sulfide present in said feed into sodium sulfite to obtain a product mixture of sodium sulfite and sodium carbonate, wherein said additional solid material is obtained by contacting at least one of a portion of said slurry supplied to step (2) and a portion of said weak aqueous slurry (b) obtained in step (2) with a cooled surface to obtain said solid material, (4) dissolving the product mixture in water, separating insoluble material from the resulting aqueous solution to obtain a clarified aqueous solution, contacting the clarified solution with a sulfur dioxide-containing gas to effect conversion of sodium carbonate present into sodium sulfite and separating insoluble material from the final aqueous solution, and (5) combining both insoluble materials, washing with water and recycling the wash water to step (1) for dissolving the smelt and/or step (4) for dissolving the oxidation product.

* * * * *